United States Patent [19]

Moreau et al.

[11] Patent Number: 4,719,712

[45] Date of Patent: Jan. 19, 1988

[54] AUTOMATICALLY CONTROLLED APPARATUS FOR TURNING PAGES

[75] Inventors: Jean-Claude A. Moreau, Vert Saint Denis; Francoise Chaudiere, Paris, both of France

[73] Assignee: Societe Anonyme Handisoft, Vert Saint Denis Cesson, France

[21] Appl. No.: 744,556

[22] PCT Filed: Oct. 3, 1984

[86] PCT No.: PCT/FR84/00218

§ 371 Date: Jul. 24, 1985

§ 102(e) Date: Jul. 24, 1985

[87] PCT Pub. No.: WO85/01479

PCT Pub. Date: Apr. 11, 1985

[30] Foreign Application Priority Data

Oct. 4, 1983 [FR] France ..... 83 15757

[51] Int. Cl.[4] ..... G09F 11/02

[52] U.S. Cl. ..... 40/475; 40/470; 40/531; 84/487

[58] Field of Search ..... 40/446, 531, 470, 476, 40/532, 475; 84/486, 487, 427, 511, 518, 519, 488, 489; 270/58; 271/21

[56] References Cited

U.S. PATENT DOCUMENTS

| | | | |
|---|---|---|---|
| 1,735,166 | 11/1929 | Hossell et al. | 84/486 |
| 2,045,804 | 6/1936 | Rosenthal et al. | 40/532 |
| 2,334,751 | 11/1943 | Chapman | 40/531 |
| 2,601,047 | 6/1952 | Merrion | 40/531 |
| 2,791,849 | 5/1957 | Brenneke | 40/531 |
| 2,897,618 | 8/1959 | Russell | 40/531 |
| 3,053,000 | 9/1962 | Schmitt | 40/531 |
| 3,475,844 | 11/1969 | Uda et al. | 40/531 |
| 3,570,154 | 3/1971 | Cosenza | 40/531 |
| 3,800,453 | 4/1974 | Kroes | 40/531 |
| 3,939,587 | 2/1976 | Weststrom | 40/531 |
| 4,102,071 | 7/1978 | D'Arcy | 40/531 |
| 4,121,361 | 10/1978 | D'Arcy | 40/470 |
| 4,160,334 | 7/1979 | Willis | 40/531 |
| 4,346,641 | 8/1982 | Kobayashi | 84/487 |
| 4,432,154 | 2/1984 | D'Arcy | 40/470 |

FOREIGN PATENT DOCUMENTS

| | | | |
|---|---|---|---|
| 685324 | 8/1966 | Belgium . | |
| 0069041 | 5/1983 | European Pat. Off. | 40/470 |
| 364655 | 9/1921 | Fed. Rep. of Germany | 84/486 |
| 119125 | 9/1981 | Japan | 40/531 |
| 143441 | 12/1953 | Sweden | 40/531 |
| 103816 | 3/1924 | Switzerland | 84/486 |
| 106707 | 9/1924 | Switzerland | 84/486 |
| 195631 | 6/1924 | United Kingdom | 84/486 |
| 1531834 | 11/1978 | United Kingdom | 40/470 |

OTHER PUBLICATIONS

"Page Turner", IBM Technical Disclosure, vol. 18, #9 (Feb. 1976), pp. 2923–2924.

*Primary Examiner*—Gene Mancene
*Assistant Examiner*—J. Hakomaki
*Attorney, Agent, or Firm*—Holman & Stern

[57] ABSTRACT

An automatic page turning device of the type comprising a movable element controlled by a motor of which the operation is controlled by a control member to be actuated by the user. It is characterized in that it comprises a suction tube to lift a page as well as a movable element comprised of a double acting pusher. The double acting pusher is situated directly above a document and is movably mounted in linear translation in the two opposite directions transverse to the side of the pages of a document and along which they are bound together. The suction tube and the double acting pusher are also movably mounted perpendicularly to the plane of a support structure.

11 Claims, 8 Drawing Figures

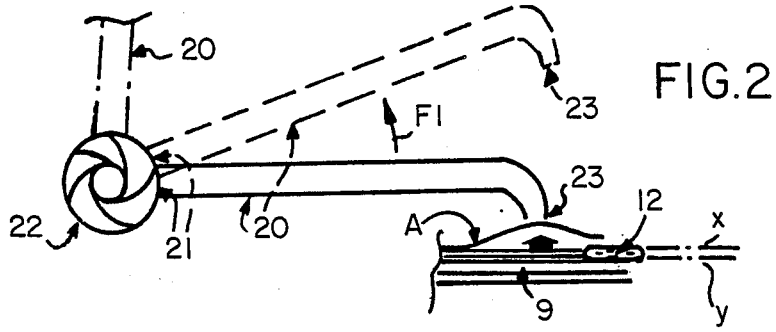
FIG.2
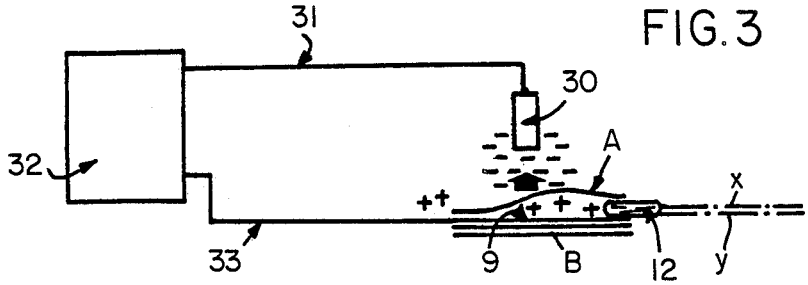
FIG.3
FIG.4
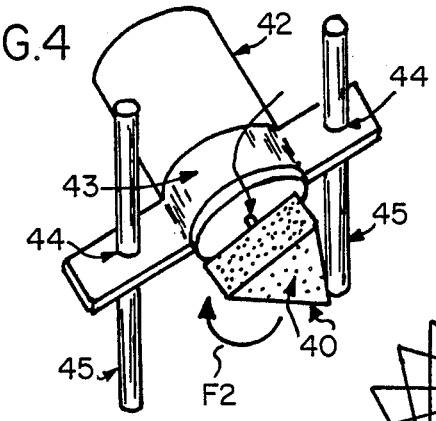
FIG.5
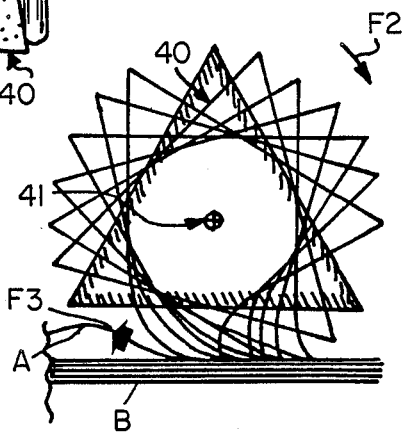

AUTOMATICALLY CONTROLLED APPARATUS FOR TURNING PAGES

CROSS REFERENCE TO RELATED APPLICATION(S)

This United States application stems from PCT International Application No. PCT/FR84/00218 filed Oct. 3, 1984.

A large number of persons, particularly those permanently or temporarily suffering from a handicap affecting the limbs, such as victims of fractures, amputees, tetraplegics, sufferers from motor infirmities of cerebral origin, traumatized or badly burnt persons and victims of phocomelia, need for work or leisure purposes to consult documents the pages of which must be periodically turned in one direction or the other in order to permit the documents to be read, consulted, sorted or, more generally, used.

Various forms of apparatus have been described previously, using diverse techniques and methods to turn the pages. In order to turn the pages, they use, inter alia, semi-adhesive tapes or pastes to lift the pages, cam driven in circular motion, mobile skids and even rotating cylinders which grip and then roll the sheets, articulated arms, clamps to fix all the sheets, and so on.

However, no apparatus known at this time provides simultaneously for turning the pages from right to left or from left to right, page by page or continuously, irrespective of the format of the documents (paperback format books, newspapers, large format magazines, etc), the stiffness and quality of the paper or card constituting the sheets and the thickness of the documents.

In contradistinction to this, the present invention makes it possible to implement an apparatus which is of itself able to implement all the movements defined above, under the diverse conditions mentioned, at variable speed as selected by the user and using the resources of microelectronics and microcomputers, employing totally novel means to this end.

To this end, an object of the invention is a device for turning bound together pages of documents placed on a support, fo the type comprising a movable element driven by a motor the operation of which is controlled by a control member to be operated by a user, characterized in that it comprises means for lifting a page and a movable element consisting of a double acting pusher to be situated directly above a document and movably mounted in linear translation in two opposite directions transverse to the bound edges of the pages of a document when the document is placed on the support, the page lifting means and the pusher being also movably mounted perpendicular to the plane of the support to receive the document.

In accordance with other characteristics of the invention:

- the pusher is substantially U-shaped with symmetrical branches the ends of which are preferably fitted with paddles which are advantageously curved, the page lifting means being operative between the symmetrical branches of the pusher;
- at least one of the two branches of the pusher is movably mounted relative to the other so that the distance between them is variable, locking means being provided for immobilizing the movable branch or branches in the required position;
- the page lifting means consist of an element which is movably mounted to move between an active position in which it is obliged to exert a lifting action on a page of a document placed on the support and an inactive position in which it is neutralized and moved away from said page;
- the element placed in the active position has to hold a lifted document page at a height greater than that of the top part of the pusher which has to be situated directly above the document;
- the element is a tube one end of which is connected to suction means whereas the other end is intended, in the active position, to be placed in the immediate proximity of a document to be placed on the support;
- the element is a member connected to a very high voltage magnetic field generator;
- the element is a friction roller mounted to rotate about an axis substantially parallel to the bound edges of the pages of a document when the document is placed on the support;
- the roller has a polyhedral, for example triangular, contour;
- the device comprises at least one motor adapted to move respectively the pusher and the movable element and controlled by programmed electronic control means associated on the one hand with means for advising the user on operation of the device and on the other hand with a sensor to sense commands from the user and constituting a control member, the device advantageously comprising a link to at least one equipment independent of itself, such as signal transmitter, a mechanism control member or otherwise.

The invention will be better understood from the following detailled description given with reference to the appended drawing. It will be understood that the description and the drawing are given by way of non-limiting example only.

FIG. 2 is a schematic view showing the operation of a sucker tube constituting means for lifting a page.

FIG. 3 is a schematic view showing the operation of a member connected to a magnetic field generator constituting means for lifting a page.

FIG. 4 is a schematic view in perspective of a traingular rotating roller mechanism constituting means for lifting a page.

FIG. 5 is a schematic view showing the operation of the rotary roller mechanism of FIG. 4.

Figure 1:
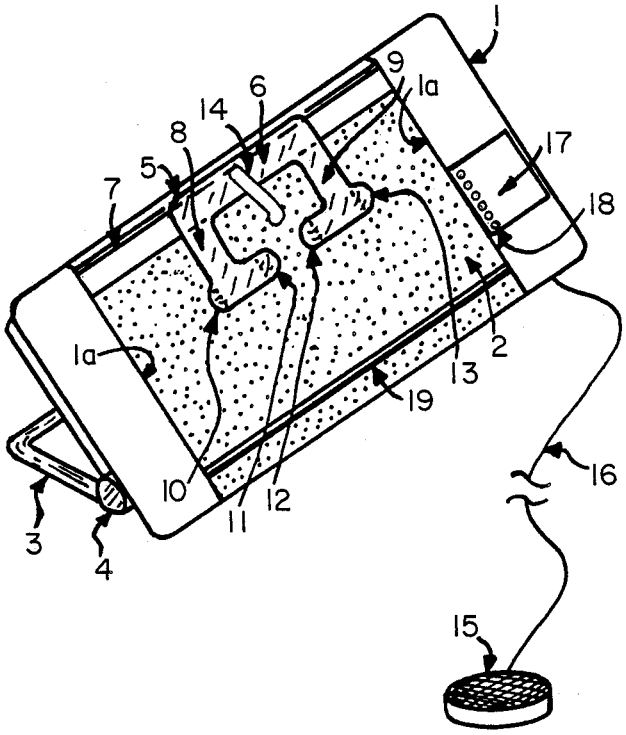
FIG. 1 is a schematic view in perspective of a device in accordance with the invention.

Referring to the drawing, it is seen that a device conforming to the invention is presented in the form of an apparatus comprising a tiltable desk 1 of which the central part 2 constitutes a support for documents and which must be placed before the user with a tilt adjustable by the user at will by means of a stand 3 mounted to pivot about lateral pivots (not visible in the drawing) and a single control knob 4.

Directly above the support 2, in its upper part, is located a generally U-shaped transparent pusher 5 consisting of a median part 6 by which it is fixed to a movable assembly (not shown) which extends horizontally in a slot 7 and two symmetrical branches 8 and 9 fitted with slightly curved paddles 10, 11, 12 and 13.

The mobile assembly is fast with a carriage placed in the apparatus and liked kinematically to a motor to transmit to the pusher 5 a linear displacement either from left to right or from right to left assuming a user situated facing the desk 1.

At the center of the median part 6 of the pusher 5 is lcoated an element 14 for lifting pages which can be implemented according to various versions, as will be explained hereinafter. This element 14 is situated on the axis of the pusher 5, that is to say the branches 8 and 9 are symmetrical relative to it.

The element 14 for lifting the pages is movably mounted so as to be either in the vicinity of the pages (active position) or away from them (inactive position). In the active position the element 14 must exert a lifting action on the page which it is near, by any known means, in order that the page be held lifted for a brief time at a level slightly higher than the top of the paddles 10-11-12-13 so that the latter may pass under the lifted page, as will be explained hereinafter.

The objective of the upward curvature of the paddles is to facilitate the sliding of the pusher over the pages and to prevent snagging of the edges of non-lifted pages, whether the pusher is moved from right to left or from left to right.

The desk 1 contains all the mechanical, electrical and electronic components necessary, supplied with power by any required type of power supply: dry cells, battery or mains supply. A control member, or sensor, is provided to give the user the facility to control the operation of the apparatus. In this instance the sensor is implemented in the form of a pushbutton 15 connected to the desk 1 by a wire 16. However, the sensor could be implemented in a different manner: keyboard, radio signal generator, remote control, moisture sensor for control by saliva (for persons with paralysed limbs), infra-red, touch senosr, doppler radar, pneumatic, etc.

On one side of the desk 1 is located a screen 17 and lamps 18 intended to give the user information on the operation of the apparatus: progress of a programmed cycle, display of a menu for choosing different functions, etc.

On the support 2 there is provided a rule 19 which is vertically mobile and slidable with moderate friction against the lateral edges 1*a* of the desk 1 which delimit the support 2, so that the user can place it in the proper position to support the document which is placed on the support 2 and thus to prevent it from slipping. In addition to or instead of the rule 19, the support 2 may also be rendered non-skid, either by means of an appropriate surface treatment or by covering it in some way so that the document remains immobile.

The combination of the pusher 5, the element 14 and the mobile assembly which carries them is mounted to move in the direction perpendicular to the plane of the support 2, that is to say for raising and lowering it.

This mobility must be automatic since it is intended to permit the pusher 5 to remain at all times at the level of the pages of the document whereas this level varies since each page turned takes away from the righthand stack and adds to the lefthand stack a height equal to its thickness. A simple and practical solution is to mount this sliding assembly on guides along which it slides freely.

To place the document on the support 2, the combination of the pusher 5 and element 14 is raised, the document is placed underneath it, on the support 2, the rule 19 is correctly positioned to support the document and the combination of the pusher 5 and element 14 is lowered into contact with the first page of the document to be turned.

Referring now to FIG. 2, it is seen that the element for lifting pages consists of a tube 20 of which the end 21 may be placed in communication with a suction device 22 and of which the ends 23 is free.

The tube 20 is pivotally mounted so as to be able to occupy either an active position shown in full line or an inactive position shown in chain-dotted line.

When the tube 20 is placed in the active position, its end 23 is placed in the proximity of the page A to be turned and its end 21 is placed in communication with the suction device 22, so that the reduced pressure established at the end 23 sucks up the page A and holds it at a level x slightly higher than that y of the summit of the paddles 10 through 13. As will be explained, the pusher 5 may then be displaced laterally so that the paddle 12 (if the page A must be turned from right to left) or the paddle 11 (if the page A must be turned from left to right) passes under the page A.

As soon as the pusher 5 begins its movement and, as a consequence of this, the paddle 11 or the paddle 12 is located under the lifted page A,l the tube 20 is lifted in the direction of the arrow F1 until it reaches the inactive position, passing inter alia through the intermediate position shown in dashed line, the end 21 then being located in line with a solid part of the suction device 22 and no longer facing an opening, so that the suction action is neutralized at the same time as the tube 20 is raised.

During these to and fro movements, the paddles 10 and 13 slide over the document without risk of snagging the edges of the pages, by virtue of the fact that they are curved upwards.

Referring now to FIG. 3, it is seen that the element for lifting pages consists of a member 30 connected by a wire 31 to a very high voltage generator 32 itself connected by a wire 33 to the pages B of the document or to the support 2, this combination constituting an electrostatic charging system.

When the member 30 is placed in the active position, it is brought into the proximity of the page A to be lifted and, at the same time, the generator 32 creates positive charges on the pages B (and thus on the page A which at this time still forms part of the pages B) and negative charges on the member 30. There results from this a magnetic field and attraction of the page A by the member 30.

Once again the page A must be held at a level x greater than that y of the paddle 12.

When the pusher 5 begins its translation movement, the member 30 is placed in the inactive position and the action of the generator 32 is neutralized.

In FIGS. 4 and 5 there is shown a variation according to which the element for lifting the pages may operate repetitively.

It comprises a friction roller 40 of non-circular cross-section, that is to say polyhedral and more specifically triangular cross-section, mounted on a rotating shaft 41 parallel to the edge of the pages B by which they are bound together. The shaft 41 is driven by a motor 42 and when the roller is lowered into the active position the motor is caused to turn so that the roller turns in the direction of the arrow F2 (FIG. 5) so as to feed by friction and in the direction of the arrow F3 a plurality of pages B one after the other if the motor 42 is allowed to run for a certain time. If, on the other hand, the motor 42 is driven stepwise, it turns the pages B one by one. In this way the user can leaf rapidly through a document.

It is seen in FIG. 4 that the motor 42 is mounted on a cradle 43 through which pass holes 44 by means of which the cradle 43 is mounted to slide freely along guides 45. This arrangement provides for automatic lifting and lowering of the assembly, as explained hereinabove with reference to the combination of the plunger 5 and the element 14.

An electronic system is placed in the desk 1 and enables the user to select the instructions to be given to the apparatus, using an appropriate sequence.

The general functioning in accordance with the invention is as follows:

The display panel or screen 17, which uses light-emitting diodes, for example, shows the user the progress of the program sequence proposed by successively lighting the diodes situated facing the functions of the program: "one page right to left", "one page left to right", "pages right to left continuously", "pages left to right continuously", awaiting a "stop" order to either of the last two, "standby" signal, waiting for a new sequence start order and, finally, a diode showing the possibility for use of the apparatus in external mode, this external mode giving access to an external socket for use of a call signal or any other environmental control type device (to open a door, for example). The program is container in read only memory placed near a microporcessor which controls the system, inside the desk 1.

After placing the document as described hereinabove and having displayed the order which he wishes to execute, the user gives a control pulse by means of the sensor 15 which may, as stated hereinabove, be of any known type and which does not constitute part of the invention.

There will now be described the cycle of movements for turning one page from right to left, the normal direction for reading in European countries.

Figure 6:
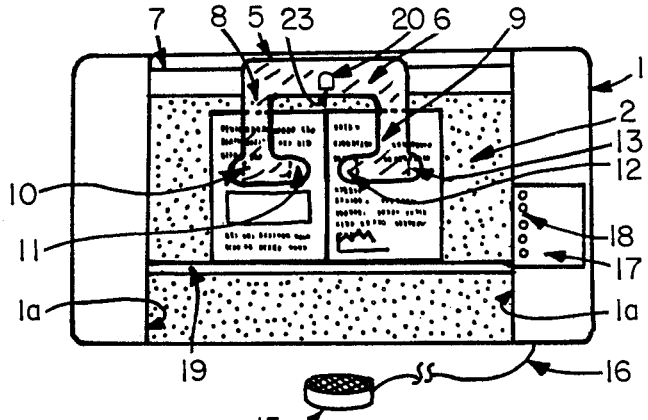
FIGS. 6, 7 and 8 are schematic views showing the operation of a device in accordance with the invention in three different phases of a cycle.
Figure 7:
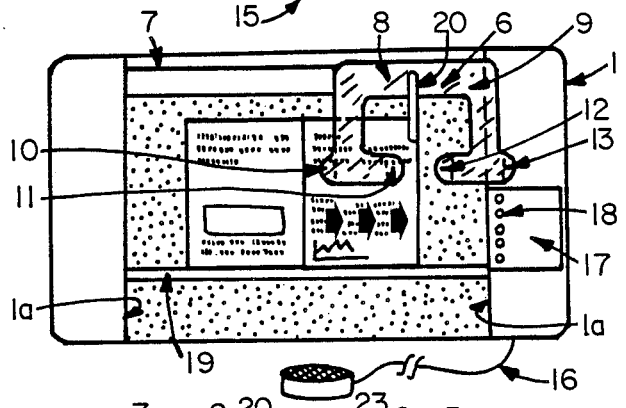
Figure 8:
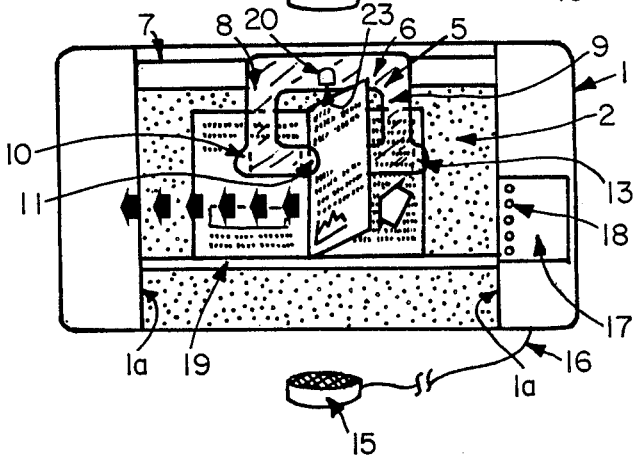

This cycle is shown in FIGS. 6 through 8:

In the starting position (FIG. 6), the transparent pusher 5 is situated at the center of the document and thus holds the pages flat. It is the starting up of the motor of the mobile assembly which marks the beginning of the cycle. The pusher 5 is placed on the right, so that the edge of the page to be turned appears between the paddles 11 and 12 and so that the element for lifting the pages (in this instance the tube 20) is positioned above the page A itself (FIG. 7).

To this stop position for the mobile assembly motor there corresponds the starting up of the lifting element. In this instance a motor (not shown) actuates a member such as a cam which inclines the sucker tube 20 towards the page A; at this time the turbine of the suction device 22 is started up, which provides for creating a reduced pressure favoring the adhesion of the page A to the tube 20; subsequently the motor again operates the cam, which raises the tube 20 and lifts the page.

In the case of a version with an elastrostatic device, the same movement is effected for the mechanical point of view, but instead of a turbine producing a pressure reduction, the very high voltage generator 32 is started up which produces an electrostatic charge at the end of the member 30.

Whatever version of the lifting element is used, at the end of this movement the page A is lifted between the two symmetrical branches 8 and 9 of the pusher 5.

The motor of the mobile assembly is run in the direction opposite to the previous direction and because of this the pusher 5 is driven towards the left. The page A remaining lifted, the righthand part of the pusher 5 passes under this page, which is progressively turned by the paddle 12 thanks to the translation from right to left of the mobile assembly and thus of the pusher 5 (FIG. 8).

Under the action of the motor the lifting element is retracted and the page A is turned without restriction. The curvature of the edges of the paddle 13 prevents the page being accidentally lifted again in the opposite direction at the end of the movement towards the left, on the return movement towards the right.

The pusher 5 is then returned to the center of the document, in which position it waits for a new cycle order, to hold down the pages.

The device is immediately reusable with the same movement or in the opposite direction. Given that the branches 8 and 9 as well as the paddles 10–13 and 11–12 are symmetrical, the explanations given hereinabove for turning a page from right to left are valid mutatis mutandis for turning a page from left to right.

An enhancement of the invention consists in using a digital display, for example employing light-emitting diodes, liquid crystals or any other known device. By virtue of automatic incrementing, this digital display provides for preselecting the number of pages to be turned in a given direction, without the apparatus stopping betweentimes. The number of pages is then chosen by means of the user's sensor. When this choice has been made, the program sequence described previously resumes and the user can select to turn a predetermined number of pages to the right or to the left.

We claim:

1. A page turning device comprising a support for a document the pages of which are to be turned, a reciprocable assembly mounted on the support for translatory back and forth movement in respective page-turning directions, the assembly including a substantially U-shaped pusher with opposite substantially symmetrical limbs, and a page lifting mechanism positioned on the assembly between the limbs, the device further including drive means for moving the assembly back and forth between respective outer positions in which the lifting mechanism can be used to elevate a page to be turned and so that movement of the assembly from one of the outer positions towards the other outer position causes a respective one of the limbs to be inserted under the elevated page and turn the page over.

2. A device as claimed in claim 1 wherein the assembly is mounted for adjusting movements toward and away from the support.

3. A device as claimed in claim 1 which includes enlarged paddle-like formations at free ends of the respective limbs.

4. A device as claimed in claim 1 including an adjustable connection in the assembly for adjusting the distance between the limbs and locking means for securing the limbs in adjusted position.

5. A device as claimed in claim 1 wherein the page lifting mechanism is vertically movable between a lowered operating page-lifting position and a raised inoperative position.

6. A device as claimed in claim 5 wherein the page lifting mechanism includes a page-lifting vacuum tube having an open end adapted to apply suction to a page for lifting same when the tube is in lowered position.

7. A device as claimed in claim 5 wherein the page lifting mechanism includes an electrical charge-applying element connected to a high voltage magnetic field generator.

8. A device as claimed in claim 5 wherein the page lifting mechanism comprises a friction roller.

9. A device as claimed in claim 8 wherein the roller has a polyhedral contour.

10. A device as claimed in claim 8 wherein the roller has a triangular contour.

11. A device as claimed in claim 1 including programmable electronic control means for operating the drive means and the page lifting mechanism, user advisory means associated with the control means for advising a user of operation of the device, and a sensor for sensing commands from the user and operating the control means.

* * * * *